United States Patent [19]

Blankenship et al.

[11] Patent Number: 4,850,858

[45] Date of Patent: Jul. 25, 1989

[54] DISPOSABLE LIQUID FUEL BURNER

[76] Inventors: Robert J. Blankenship, 31127 North Cripple Creek Dr., Magnolia, Tex. 77355; Robert J. Hamblin, 6903 Enns La., Spring, Tex. 77379

[21] Appl. No.: 197,510

[22] Filed: May 23, 1988

[51] Int. Cl.[4] ..... F23D 3/24

[52] U.S. Cl. ..... 431/320; 431/298; 431/325; 126/43; 126/45

[58] Field of Search ..... 431/298, 320, 325; 126/43, 44, 45, 261, 262, 263, 265, 266, 46, 49, 50

[56] References Cited

U.S. PATENT DOCUMENTS

| | | | |
|---|---|---|---|
| 960,064 | 5/1910 | Bergstein | 126/43 |
| 3,262,290 | 7/1966 | Huber | 431/325 |
| 3,888,620 | 6/1975 | Devon | 431/325 X |
| 4,002,235 | 1/1977 | Donnelly | 126/263 X |
| 4,604,053 | 8/1986 | de la Rosa | 431/320 X |
| 4,611,986 | 9/1986 | Menter et al. | 431/320 |
| 4,624,633 | 11/1986 | Bandel | 431/320 |

*Primary Examiner*—Margaret A. Pogarino

[57] ABSTRACT

A disposable liquid fuel burner is disclosed which comprises a container having a closed bottom, an enclosing sidewall and an open top and at least partially filled with a liquid fuel. A flat support member is supported adjacent the open top above the liquid fuel and having a centrally located opening receiving one end of an elongated wick of a fibrous material overlying the support member and having its other end immersed in the liquid. The support member may be a cardboard or plastic disk supported on legs or a cylinder or may be a cup-shaped member. A fibrous bat of a refractory, non-combustible material substantially fills the open top and overlies the support member and the end of the wick supported thereon. A bat of a plastic, e.g., polyurethane, foam material overlies the fibrous bat. A top cover is secured on the container closing the open top and is at least partially removable, e.g. removable cover or pull-tap opening cover, to expose the plastic foam bat, whereby the burner may be ignited with the flame extending substantially uniformly from said entire top opening and continuing to burn until extinguished or said liquid fuel is exhausted. The plastic foam bat is combustible and burns off in use with the flame being subsequently emitted from the surface of said fibrous bat. A flat disc or ring member with an opening smaller than the lid is provided to control the size of the flame and rate of burning.

20 Claims, 2 Drawing Sheets

DISPOSABLE LIQUID FUEL BURNER

FIELD OF THE INVENTION

This invention relates generally to a disposable liquid fuel burner and more particularly a burner having an easily opened top and arranged for the flame to be emitted from substantially the entire top opening of the burner.

BACKGROUND OF THE INVENTION

Restaurants and other food preparers and servers have long required simple means for heating or maintaining foods at an elevated temperature for extended periods of time. The need has been particularly strong for buffet service or for table service where some items are kept hot at the table.

Canisters containing jellied fuels, under the name CANNED HEAT, have been in use for many years. Next, canisters with liquid fuels were used. At first volatile alcohol fuels were used, but more recently fuels of low volatility, such as glycols, have come into use. The usual liquid fuel burner has a wick which concentrates the flame into a small area. There has been a need for a liquid fuel burner having a construction which spreads the flame over a substantial area for a less concentrated application of heat.

Devon U.S. Pat. No. 3,888,620 discloses a canned burner using a wax fuel and having a tubular wick which protrudes above the can at several points.

Huber U.S. Pat. No. 3,262,290 discloses a canned burner using a liquid fuel and a wick stone.

de la Rosa U.S. Pat. No. 4,604,053 discloses a canned burner using a liquid fuel and having a flat wick which protrudes above the can through an opening so that the middle portion of the wick is exposed and the ends are positioned in the liquid fuel.

Bandel U.S. Pat. No. 4,624,633 discloses a canned burner using a liquid fuel and having a central wick which protrudes above the can through a center opening. Glycol fuels are claimed as the novel feature.

Menter U.S. Pat. No. 4,611,986 discloses a canned burner using a liquid fuel and having a central flat folded wick which protrudes above the can through a center opening.

Norwegian patent No. 59,224 and British patent No. 845,639 disclose liquid fuel burners with special wick constructions.

The present invention is distinguished from this and other prior art by a disposable liquid fuel burner which comprises a container having a closed bottom, an enclosing sidewall and an open top and at least partially filled with a liquid fuel. A flat support member is supported adjacent the open top above the liquid fuel and having a centrally located opening receiving one end of an elongated wick of a fibrous material, e.g., cotton or glass fibers, overlying the support member and having its other end immersed in the liquid. The support member may be a cardboard or plastic disk supported on legs or a cylinder or may be a cup-shaped member. A fibrous bat of a refractory, non-combustible material, e.g., glass fibers, substantially fills the open top and overlies the support member and the end of the wick supported thereon. A bat of a plastic, e.g., polyurethane, foam material overlies the fibrous bat. A top cover is secured on the container closing the open top and is at least partially removable, e.g. removable cover or pull-tab opening cover, to expose the plastic foam bat, whereby the burner may be ignited with the flame extending substantially uniformly from said entire top opening and continuing to burn until extinguished or said liquid fuel is exhausted. The plastic foam bat is combustible and burns off in use with the flame being subsequently emitted from the surface of said fibrous bat.

SUMMARY OF THE INVENTION

It is therefore a general object of this invention to provide a new and improved portable burner for cooking, for heating or for maintaining food hot at a point of service.

It is another object of the present invention to provide a new and improved portable liquid fuel burner for cooking, for heating or for maintaining food hot at a point of service.

It is another object of this invention to provide a new and improved portable liquid fuel burner for cooking, for heating or for maintaining food hot at a point of service and having a construction permitting generation of a flame spread over a substantial area.

It is another object of this invention to provide a new and improved portable liquid fuel burner for cooking, for heating or for maintaining food hot at a point of service and having a construction permitting generation of a flame spread over the entire top of the can in which the fuel is carried and stored.

It is another object of this invention to provide a new and improved portable liquid fuel burner for cooking, for heating or for maintaining food hot at a point of service and having a canister construction which is simple and inexpensive to manufacture and easy to use.

Other objects of the invention will become apparent from time to time throughout the specification and claims as hereinafter related.

The above noted and other objects of the invention are accomplished by a disposable liquid fuel burner comprises a container having a closed bottom, an enclosing sidewall and an open top and at least partially filled with a liquid fuel. A flat support member is supported adjacent the open top above the liquid fuel and having a centrally located opening receiving one end of an elongated wick of a fibrous material, e.g., cotton or glass fibers, overlying the support member and having its other end immersed in the liquid. The support member may be a cardboard or plastic disk supported on legs or a cylinder or may be a cup-shaped member. A fibrous bat of a refractory, non-combustible material, e.g., glass fibers, substantially fills the open top and overlies the support member and the end of the wick supported thereon. A bat of a plastic, e.g., polyurethane, foam material overlies the fibrous bat. A top cover is secured on the container closing the open top and is at least partially removable, e.g. removable cover or pull-tab opening cover, to expose the plastic foam bat, whereby the burner may be ignited with the flame extending substantially uniformly from said entire top opening and continuing to burn until extinguished or said liquid fuel is exhausted. The plastic foam bat is combustible and burns off in use with the flame being subsequently emitted from the surface of said fibrous bat.

DESCRIPTION OF A PREFERRED EMBODIMENT

Figure 1:
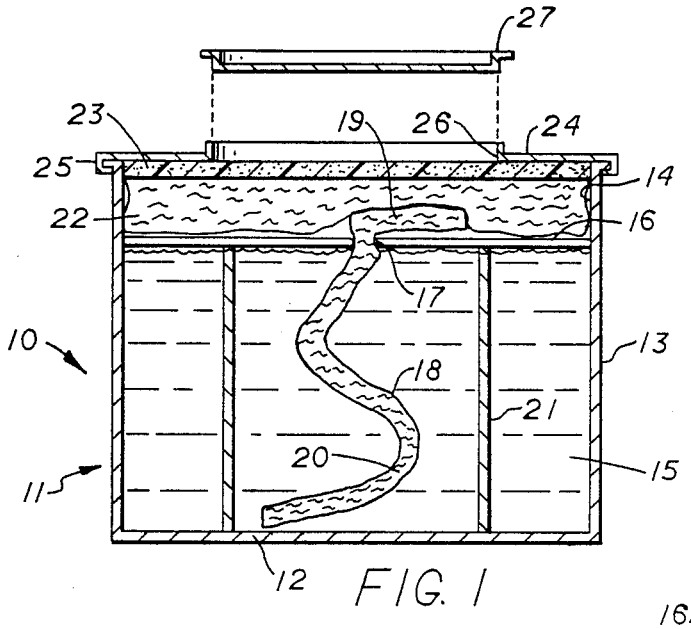
FIG. 1 is a vertical central sectional view of a disposable liquid fuel burner illustrating one preferred embodiment of this invention.
Figure 2:
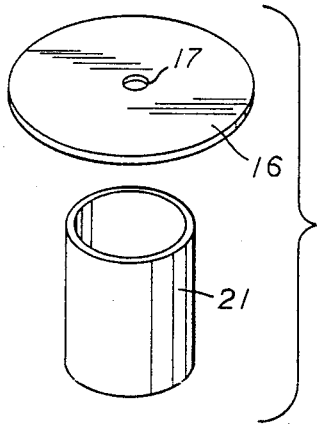
FIG. 2 is an exploded isometric view of the internal support members for the disposable liquid fuel burner shown in FIG. 1.

Referring to the drawings by numerals of reference, there is shown in FIG. 1 a vertical central sectional view of a disposable liquid fuel burner 10 which comprises a container 11 having a closed bottom wall 12, an enclosing sidewall 13 and an open top 14. Container 11 is at least partially filled with liquid fuel 15, preferably a relatively non-volatile fuel such as diethylene glycol or the like.

Figure 3:
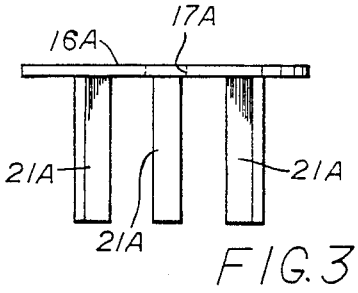
FIG. 3 is a view in side elevation of another embodiment of the internal support member for the disposable liquid fuel burner of FIG. 1.
Figure 4:
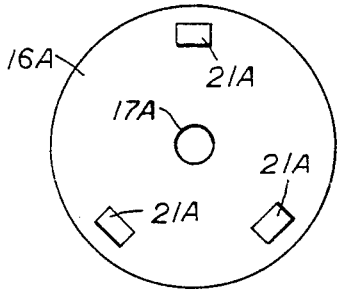
FIG. 4 is a top plan view of the support member shown in FIG. 3.

A flat support member 16 is supported adjacent the open top 14 above the level of the liquid fuel 15. Support member 16 has a centrally located opening 17 receiving one end of an elongated wick 18 of a fibrous material, e.g., cotton or glass fibers. The upper end 19 of wick 18 overlies support member 16 and the other end 20 is immersed in the liquid fuel 15. Support member 16 is a cardboard disk supported on a cardboard cylinder 21. The support member may also be of a one-piece, molded-plastic construction as shown in FIGS. 3 and 4 where flat support member **16*a* has central opening 17*a* and is supported on integrally formed legs 21*a***.

A fibrous bat 22 of a refractory, non-combustible material, e.g., glass fibers, substantially fills the open container top 14 and overlies the support member and the end of the wick supported thereon. A bat 23 of a plastic, e.g., polyurethane, foam material overlies fibrous bat 22. A top wall member 24 cover is secured at its periphery 25 on container 11 closing open top 14. Wall member 24 has a central opening 26 which receives a removable cover 27.

OPERATION

In use, cover or lid 27 is removed from container 11 to expose the portion of plastic foam bat 23 seen through opening 26. Liquid fuel 15 is drawn by wick 18 to saturate glass fiber bat 22 and plastic foam bat 23. The burner is ignited by a match or other lighter and flame is emitted uniformly from the entire opening 26. Plastic foam bat 23 slowly burns off with the burning fuel, leaving glass fiber bat 22 exposed. In subsequent operation, the flame is emitted from fuel carried by wick 18 and distributed uniformly over glass fiber bat 22.

ANOTHER PREFERRED EMBODIMENT

Figure 5:
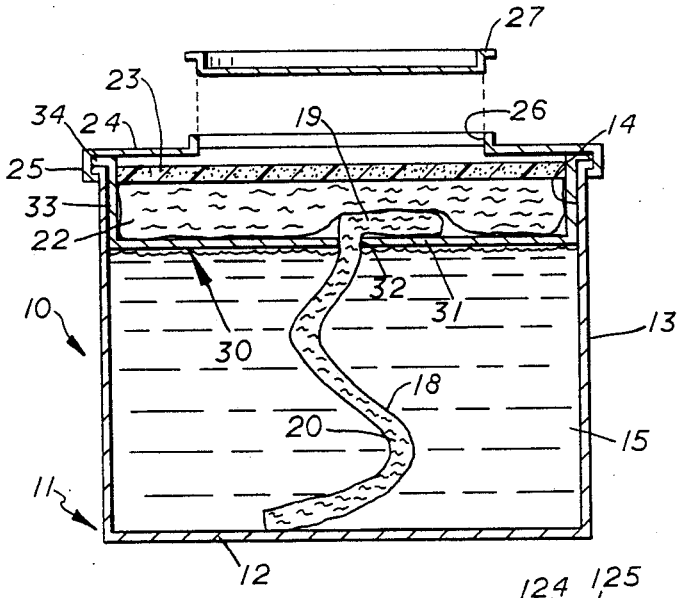
FIG. 5 is a vertical central sectional view of a disposable liquid fuel burner illustrating another preferred embodiment of this invention.

Referring to the drawings by numerals of reference, there is shown in FIG. 5 a view of another embodiment of the invention utilizing a different support for the glass fiber bat and plastic foam bat. The structure is otherwise the same as that shown in FIG. 1 and like reference numerals are applied to like parts.

In FIG. 5, there is shown a vertical central sectional view of a disposable liquid fuel burner 10 which comprises a container 11 having a closed bottom wall 12, an enclosing sidewall 13 and an open top 14. Container 11 is at least partially filled with liquid fuel 15, preferably a relatively non-volatile fuel such as diethylene glycol or the like.

A flat cup-shaped support member 30 (replacing support member 16) is supported adjacent the open top 14 above the level of the liquid fuel 15. Support member 30 has a flat bottom wall 31 with centrally located opening 32 receiving one end of an elongated wick 18 of a fibrous material, e.g., cotton or glass fibers. The upper end 19 of wick 18 overlies bottom wall 31 of support member 30 and the other end 20 is immersed in the liquid fuel 15. Support member 30 is a stamped sheet metal cup having a surrounding side wall 33 and is outwardly flanged at 34 to be supported on the upper end of container side wall 13.

A fibrous bat 22 of a refractory, non-combustible material, e.g., glass fibers, substantially fills the open container top 14 and overlies the support member and the end of the wick supported thereon. A bat 23 of a plastic, e.g., polyurethane, foam material overlies fibrous bat 22. A top wall member 24 cover is secured at its periphery 25 on container 11 closing open top 14. Wall member 24 has a central opening 26 which receives a removable cover 27.

OPERATION

The operation is as described for the embodiment of FIG. 1. Cover or lid 27 is removed from container 11 to expose the portion of plastic foam bat 23 seen through opening 26. Liquid fuel 15 is drawn by wick 18 to saturate glass fiber bat 22 and plastic foam bat 23. The burner is ignited by a match or other lighter and flame is emitted uniformly from the entire opening 26. Plastic foam bat 23 slowly burns off with the burning fuel, leaving glass fiber bat 22 exposed. In subsequent operation, the flame is emitted from fuel carried by wick 18 and distributed uniformly over glass fiber bat 22.

STILL ANOTHER PREFERRED EMBODIMENT

Figure 6:
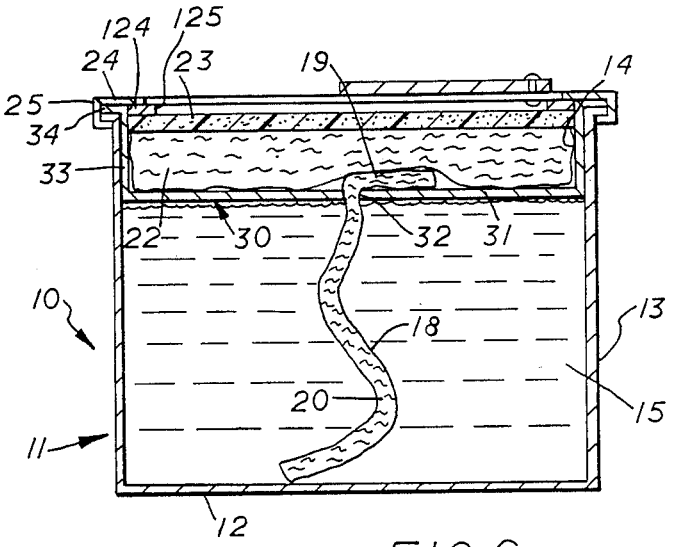
FIG. 6 is a vertical central sectional view of a disposable liquid fuel burner illustrating another preferred embodiment of this invention having a pull-top construction.
Figure 7:
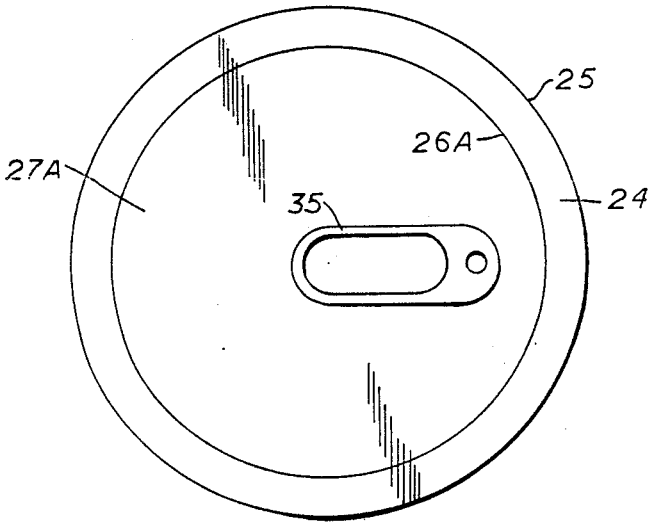
FIG. 7 is a top plan view of the disposable liquid fuel burner shown in FIG. 6.

Referring to the drawings by numerals of reference, there is shown in FIGS. 6 and 7 a view of another embodiment of the invention utilizing a different top opening. The structure is otherwise the same as that shown in FIG. 5 although this cover arrangement may be used with the embodiment of FIG. 1. In this embodiment, like reference numerals are applied to like parts.

In FIG. 6, there is shown a vertical central sectional view of a disposable liquid fuel burner 10 which comprises a container 11 having a closed bottom wall 12, an enclosing sidewall 13 and an open top 14. Container 11 is at least partially filled with liquid fuel 15, preferably a relatively non-volatile fuel such as diethylene glycol or the like.

A flat cup-shaped support member 30 (replacing support member 16) is supported adjacent the open top 14 above the level of the liquid fuel 15. Support member 30 has a flat bottom wall 31 with centrally located opening 32 receiving one end of an elongated wick 18 of a fibrous material, e.g., cotton or glass fibers. The upper end 19 of wick 18 overlies bottom wall 31 of support member 30 and the other end 20 is immersed in the liquid fuel 15. Support member 30 is a stamped sheet metal cup having a surrounding side wall 33 and is outwardly flanged at 34 to be supported on the upper end of container side wall 13.

A fibrous bat 22 of a refractory, non-combustible material, e.g., glass fibers, substantially fills the open container top 14 and overlies the support member and the end of the wick supported thereon. A bat 23 of a plastic, e.g., polyurethane, foam material overlies fibrous bat 22.

A top wall member 24 is secured at its periphery 25 on container 11 closing open top 14. Wall member 24 has a scored line of weakness 26*a* which defines a removable cover 27*a*. A pull-tab 35 is secured on cover 27*a* and is operable to remove the cover in the well-known manner. This pull-tab removable cover arrangement has been shown in connection with the embodiment of FIG. 5 but obviously can be used with the embodiment of FIG. 1 as well. A flat disc or ring member 124 with an opening 125 smaller than the opening 26*a* is provided to control the size of the flame and rate of burning. The burn rate can also be controlled by the size of opening 32 for wick 18. The length and density of the wick 18 also contributes to control of the size of flame and burn rate. All of these sizes may be predetermined for a particular application for the burner.

OPERATION

The operation is as described for the embodiments of FIGS. 1 and 5. Cover or lid 27*a* is removed from container 11 by pull-tab 35 expose plastic foam bat 23 across the entire opening. As in the other embodiments, liquid fuel 15 is drawn by wick 18 to saturate glass fiber bat 22 and plastic foam bat 23. The burner is ignited by a match or other lighter and flame is emitted uniformly from the entire opening 26. Plastic foam bat 23 slowly burns off with the burning fuel, leaving glass fiber bat 22 exposed. In subsequent operation, the flame is emitted from fuel carried by wick 18 and distributed uniformly over glass fiber bat 22.

While this invention has been described fully and completely, with special emphasis on certain preferred embodiments, it should be understood that, within the scope of the appended claims, the invention may be practiced otherwise than as specifically described herein.

We claim:

1. A disposable liquid fuel burner comprising a container having a closed bottom, an enclosing sidewall and an open top, a liquid fuel at least partially filling said container, a flat support member supported adjacent said open top above said liquid fuel and having a centrally located opening, an elongated wick of a fibrous material having one end immersed in said liquid fuel and extending through said support member opening and overlying said support member, a fibrous bat of a refractory, non-combustible material substantially filling said open top and overlying said support member and the end of said wick supported thereon, a bat of a plastic foam material overlying said fibrous bat, and a top cover secured on said container closing said open top, said top cover being at least partially removable to expose said plastic foam bat, whereby said burner may be ignited with the flame extending substantially uniformly from said entire top opening and continuing to burn until extinguished or said liquid fuel is exhausted.

2. A disposable liquid fuel burner according to claim 1 in which said plastic foam bat is combustible and burns off in use with the flame being subsequently emitted from the surface of said fibrous bat.

3. A disposable liquid fuel burner according to claim 1 in which said fibrous bat is of glass fibers and said wick is cotton or glass fibers.

4. A disposable liquid fuel burner according to claim 1 in which said foam plastic is polyurethane foam.

5. A disposable liquid fuel burner according to claim 1 in which said fibrous bat is of glass fibers and said wick is cotton or glass fibers, and said foam plastic is polyurethane foam.

6. A disposable liquid fuel burner according to claim 1 in which said support member is a disk shaped member positioned inside said open top and having supporting means extending to said closed bottom wall.

7. A disposable liquid fuel burner according to claim 6 in which supporting means is a cylinder on which said disk rests.

8. A disposable liquid fuel burner according to claim 6 in which supporting means are legs formed integrally with said disk.

9. A disposable liquid fuel burner according to claim 1 in which said support member is a disk shaped cardboard member positioned inside said open top resting on a cardboard cylinder.

10. A disposable liquid fuel burner according to claim 1 in which said support member is a disk shaped plastic member positioned inside said open top with integrally formed legs supporting the same on said closed bottom wall.

11. A disposable liquid fuel burner according to claim 1 in which said support member is a cup-shaped member fitted inside said open top and having a closed bottom wall with said opening for said wick therein, said fibrous bat and said plastic foam bat being supported inside said cup-shaped member.

12. A disposable liquid fuel burner according to claim 1 in which said top cover comprises a disk-shaped top wall member sealed at its periphery to said container open top and having a central opening with a removable lid positioned therein.

13. A disposable liquid fuel burner according to claim 1 in which said top cover comprises a disk-shaped top wall member sealed at its periphery to said container open top and having a central opening with a removable lid positioned therein, said support member is a cup-shaped member fitted inside said open top, secured in place by said top cover, and having a closed bottom wall with said opening for said wick therein, said fibrous bat and said plastic foam bat being supported inside said cup-shaped member.

14. A disposable liquid fuel burner according to claim 1 in which said top cover comprises a disk-shaped top wall member sealed at its periphery to said container open top and having a central opening with a removable lid positioned therein, said support member is a cup-shaped member fitted inside said open top, secured in place by said top cover, and having a closed bottom wall with said opening for said wick therein, said fibrous bat is of glass fibers and said wick is cotton or glass fibers, said foam plastic is polyurethane foam, and said fibrous bat and said plastic foam bat are supported inside said cup-shaped member.

15. A disposable liquid fuel burner according to claim 1 including said top cover comprises a disk-shaped top wall member sealed at its periphery to said container open top and having a scored line of weakness defining a portion operable to be removed to provide an opening, and a pull-tab secured on said top wall member inside said scored line of weakness for removing the same to provide said opening.

16. A disposable liquid fuel burner according to claim 1 including said top cover comprises a disk-shaped top wall member sealed at its periphery to said container open top and having a scored line of weakness defining a portion operable to be removed to provide an opening, a pull-tab secured on said top wall member inside said scored line of weakness for removing the same to provide said opening, said support member is a cup-shaped member fitted inside said open top, secured in place by said top cover, and having a closed bottom wall with said opening for said wick therein, said fibrous bat and said plastic foam bat being supported inside said cup-shaped member.

17. A disposable liquid fuel burner according to claim 1 including said top cover comprises a disk-shaped top wall member sealed at its periphery to said container open top and having a scored line of weakness defining a portion operable to be removed to provide an opening, a pull-tab secured on said top wall member inside said scored line of weakness for removing the same to provide said opening, said support member is a cup-shaped member fitted inside said open top, secured in place by said top cover, and having a closed bottom wall with said opening for said wick therein, a flat ring shaped member positioned over said foam plastic bat and below said top wall member having an opening of predetermined size for controlling the size of flame and rate of burning, said foam plastic is polyurethane foam, and said fibrous bat and said plastic foam bat are supported inside said cup-shaped member.

18. A disposable liquid fuel burner according to claim 1 in which supporting means is a cylinder on which said disk rests, said fibrous bat is of glass fibers and said wick is cotton or glass fibers, and said foam plastic is polyurethane foam.

19. A disposable liquid fuel burner according to claim 1 in which said support member is a disk shaped cardboard member positioned inside said open top resting on a cardboard cylinder, said fibrous bat is of glass fibers and said wick is cotton or glass fibers, and said foam plastic is polyurethane foam.

20. A disposable liquid fuel burner according to claim 1 in which said support member is a disk shaped plastic member positioned inside said open top with integrally formed legs supporting the same on said closed bottom wall, said fibrous bat is of glass fibers and said wick is cotton or glass fibers, and said foam plastic is polyurethane foam.

* * * * *